73-632 SR
OR 4,033,180
[redacted] [redacted]
X73/649

United States Patent [19]

Massa

[11] 4,033,180

[45] July 5, 1977

[54] ULTRASONIC MICROPHONE FOR OPERATING WITH AN ACCUMULATED LAYER OF MUD OVER ITS VIBRATILE SURFACE WITHOUT CHANGE IN SENSITIVITY WITHIN ITS PRESCRIBED FREQUENCY RANGE

[75] Inventor: Frank Massa, Cohasset, Mass.

[73] Assignee: Fred M. Dellorfano, Jr. and Donald P. Massa, Trustees of The Stoneleigh Trust u/d/t, Cohasset, Mass.

[22] Filed: Apr. 26, 1976

[21] Appl. No.: 680,425

[52] U.S. Cl. ..... 73/71.5 US
[51] Int. Cl.² ..... H04R 7/00
[58] Field of Search ..... 73/552, 555, 556, 557, 73/70, 71.5 US

[56] References Cited

UNITED STATES PATENTS

| | | | |
|---|---|---|---|
| 2,978,669 | 4/1961 | Harris | 179/179 |
| 3,584,243 | 6/1971 | Fabian | 310/8.4 |

*Primary Examiner*—George G. Stellar

[57] ABSTRACT

A microphone is described for operating in dirty environments where a layer of dirt or mud may accumulate over the vibratile surface of microphone. The microphone is designed with its vibratile diaphragm having a mass greater than 0.4 gm/sq cm of diaphragm area so that an added layer of dirt over its surface will not cause any significant change in the sensitivity of the microphone over its prescribed frequency range of operation.

6 Claims, 3 Drawing Figures

ULTRASONIC MICROPHONE FOR OPERATING WITH AN ACCUMULATED LAYER OF MUD OVER ITS VIBRATILE SURFACE WITHOUT CHANGE IN SENSITIVITY WITHIN ITS PRESCRIBED FREQUENCY RANGE

This invention is concerned with the design of a microphone whose sensitivity remains unchanged over its operating frequency band when the microphone is used in an environment which permits its sound sensitive surface to become covered with an accumulation of dirt or mud such as will occur when the microphone is mounted on the underneath side of an automobile and the automobile is driven through mud puddles or slush.

An example of an application for this inventive microphone is in its use for monitoring the air pressure in a tire while the tire is mounted on a vehicle and the vehicle is operating under its normal usual conditions. For one such application, an ultrasonic whistle is attached to the rim of the wheel so that the whistle communicates with the air volume contained inside the tire. A valve arrangement associated with the whistle prevents the flow of air through the whistle when the tire pressure is normal. When the tire pressure falls to a preset value, the valve opens and the air inside the tire activates the whistle so that a sound signal is generated. The signal will continue until the tire pressure falls by a preset small amount, at which time the valve automatically shuts off the air supply to the whistle to prevent the escape of all the air in the tire.

While the whistle is operating, a microphone mounted in the vicinity of the wheel will pick up the sound signal from the whistle and convert it to an electrical signal. After suitable amplification, the electrical signal will activate a dashboard indicator to show that the air pressure in the tire has reached a minimum safe level, and thus alerts the driver that the tire must be serviced before he can continue to drive at full speed. The microphone used in such an application will be exposed to all types of road conditions where dirt, mud or slush can splash over the microphone surface. If this happens to a conventional microphone constructed with a conventional lightweight diaphragm, such as is generally employed in microphone structures designed for use in detecting sound signals in air, the accumulation of a layer of dirt over the diaphragm surface will materially change the effective mass of the vibrating diaphragm, and thus significantly modify the sensitivity and response characteristic of the microphone. Under such conditions, the tire pressure sensing system will become inaccurate or inoperative. The present invention overcomes these objections.

The primary object of this invention is to design a microphone which is capable of operating in a dirty environment such as when it is mounted on the underside of an automobile and the automobile is driven through mud puddles or slush, and the microphone remains unchanged in its sensitivity to sound signals generated within a prescribed frequency band.

A further object of this invention is to design a microphone such that the addition of a layer of dirt or mud over its sound sensitive surface will not appreciably change the sensitivity of the microphone to sounds generated in the prescribed frequency band of operation.

A still further object of this invention is to design a microphone for operating with a layer of dirt covering its sound sensitive surface and insure that the mass of the dirt layer does not significantly change the total mass of the vibratile diaphragm portion of the microphone, thereby preventing significant changes in microphone sensitivity when the microphone is used in its intended application.

The novel features which are characteristic of this invention are set forth with particularly in the appended claims. The invention itself, however, both as to its method of operation as well as additional objects and advantages thereof will be best understood by reference to the following description of a preferred embodiment taken in conjunction with the accompanying drawings, in which:

Figure 1:
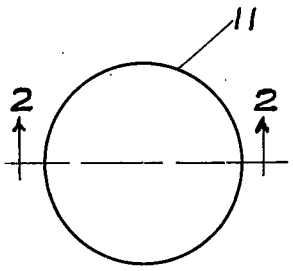
FIG. 1 is a plan view of a microphone which illustrates the teachings of this invention.
Figure 2:
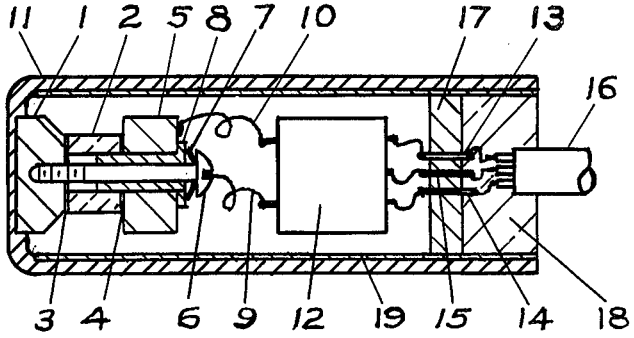
FIG. 2 is a longitudinal section taken along the line 2—2 of FIG. 1.

Referring to FIGS. 1 and 2, which schematically illustrates an embodiment of my invention in which a preferred structural configuration of the microphone is shown, the reference character 1 illustrates the vibratile diaphragm portion of the microphone, which is shown as a circular piston which may be metal, such as aluminum. One electrode surface of the polarized ceramic element 2 is attached with conducting epoxy cement 3 to the surface of the aluminum diaphragm 1. The other electrode surface of the ceramic is similarly attached with conducting epoxy cement 4 to the steel inertial mass member 5. A machine screw 6 is employed, as illustrated, to provide a mechanical clamp for the assembled elements. A spring washer 7 is preferably placed under the head of the screw to control the compressive stress on the elements and to isolate the screw from the vibrations of the inertial mass member 5. An insulating plastic bushing 8 serves the dual purpose of aligning parts 2 and 5 and providing electrical insulation between the screw 6 and the steel member 5. Electrical conductors 9 and 10 soldered respectively to the screw 6 and to the steel member 5 provide electrical connection through the conducting epoxy to the ceramic electrodes. The transducer assembly thus far described is similar to the construction shown in greater detail in U.S. Pat. No. 3,739,327.

The microphone element assembly is preferably bonded to the inside surface of a rubber boot 11, as illustrated in FIG. 2. The face of the vibratile diaphragm 1 is preferably vulcanized directly to the inner surface of the rubber boot by using part 1 as an insert when molding the boot 11.

The insulated conductors 9 and 10 are connected to the input terminals of the electronic circuit 12. The output connections from the electronic circuit 12 are connected to the terminals 13, 14 and 15, which are in turn connected to the multiconductor cable 16, as indicated. The output terminals are held by an insulating disc member 17, which is located within the opening of the boot, as shown. Potting compound 18 is preferably used to achieve a waterproof seal for the cable entrance to the boot assembly, as shown. A rigid thin-walled tubular member 19 is preferably inserted as a liner to the rubber boot 11 before completing the assembly, so that the completed structure will have a rigid body.

Figure 3:
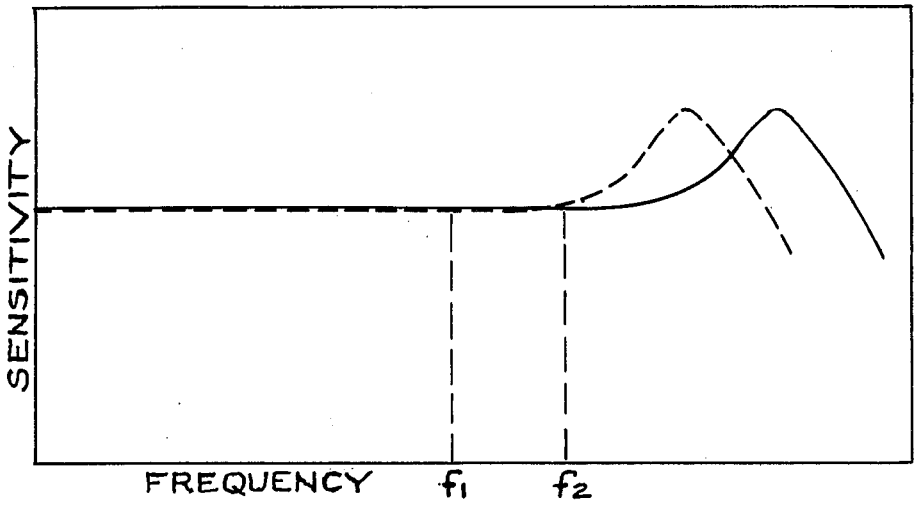
FIG. 3 shows the receiving response characteristic of the inventive microphone before and after a layer of mud is smeared over the microphone surface.

The receiving response-frequency characteristic of the transducer assembly illustrated in FIG. 2 is shown by the solid line in FIG. 3. The desired frequency band of operation of the microphone assembly is indicated by the frequency region between $f_1$ and $f_2$. In accordance with the teachings of this invention, it is desirable to set the resonant frequency of the transducer assembly above the frequency $f_2$, as illustrated by the peak resonant response of the solid curve. Also, in accordance with the further teachings of this invention, the reduction in resonant frequency caused by the accumulation of a layer of dirt or mud on the surface of the microphone must not be of such great magnitude that the sensitivity of the microphone over its prescribed operating frequency range $f_1$ to $f_2$ is significantly changed. In other words, the addition of the mud layer must not drop the resonance much below the value shown by the dotted line response curve in FIG. 3. A specific example will be given to more fully describe the teachings of my invention in achieving the desired objectives.

Under typical driving conditions through mud, it was experimentally found that a layer of mud about 1/16 inch thick could accumulate over the surface of the microphone, and that the added mass contributed by the mud layer was approximately 0.2 gms per sq. cm. of diaphragm area. This amount of added mass to the surface of a typical light weight diaphragm as employed in a conventional microphone would cause a considerable change in microphone sensitivity. Therefore, in order to prevent large changes in sensitivity in the inventive microphone, it is necessary that the mass of the diaphragm portion 1 be made significantly greater than the accumulated mass of the mud layer. I have found that satisfactory results can be achieved if the mass of the diaphragm 1 is made greater than twice the mass of the accumulated mud layer. Therefore the minimum mass of the diaphragm 1 that was found necessary to maintain the desired uniform sensitivity over the prescribed operating frequency range under all driving conditions through mud and slush, and for varying accumulations of mud or snow up to about 1/16 inch thick, was approximately 0.4 grams per sq. cm. of diaphragm area. Thus the thickness of the diaphragm 1 in Fig. 1 should be chosen such that the mass of the diaphragm is greater than approximately 0.4 gms/sq. cm. of diaphragm area.

Applicant has chosen a well-known basic type of ceramic transducer construction to illustrate the teachings of his invention, and Applicant makes no claim to the basic transducer vibrating system. The invention resides only in the novel design combinations that have been described to achieve the solution to the problem of maintaining uniform sensitivity for a microphone that is required to operate under severe conditions of accumulated dirt and achieve the objects of the invention as set forth in the specification.

It will be obvious to one skilled in the art that additional modifications may be made to the specific embodiments which have been used for illustrating the invention; therefore, the intended claims are intended to cover all equivalents that will fall within the true spirit and scope of this invention.

I claim:

1. In combination in a microphone adapted for use in the measurement of ultrasonic sound signals transmitted in air in a dirty environment, such as when mounted underneath the body of an automobile, a vibratile element responsive to the presence of an ultrasonic sound signal whose pitch lies within a prescribed ultrasonic frequency band, said vibratile element including a diaphragm portion and an electroacoustic transducer portion, said vibratile element characterized in that the resonant frequency of said vibratile element lies above said prescribed ultrasonic frequency band, said vibratile element further characterized in that its diaphragm portion has a mass greater than 0.4 gram per sq. cm. of diaphragm area.

2. The invention in claim 1 further characterized in that the sensitivity of said microphone to said sound signal remains essentially unchanged when a layer of accumulated dirt or mud covers the sound sensitive surface of said microphone up to a thickness as great as 1/16 inch.

3. The invention in claim 1 further characterized in that said diaphragm comprises a circular piston.

4. The invention in claim 3, and a housing structure for enclosing said vibratile element, further characterized in that said circular piston is bonded to the inside end surface of said housing structure.

5. The invention in claim 4 further characterized in that said housing structure is an elastomer.

6. The invention in claim 5 further characterized in that a rigid tubular sleeve is inserted as a liner within the inner peripheral wall of said elastomer housing structure.

* * * * *